US010252531B2

(12) United States Patent
Schnepp

(10) Patent No.: US 10,252,531 B2
(45) Date of Patent: Apr. 9, 2019

(54) SINGLE PASS INKJET PRINTER

(71) Applicant: PADALUMA INK-JET-SOLUTIONS GMBH & CO. KG, Markt Erlbach (DE)

(72) Inventor: Martin Schnepp, Nuremberg (DE)

(73) Assignee: PadaLuma Ink-Jet-Solutions GmbH & Co. KG, Markt Erlbach (DE)

( * ) Notice: Subject to any disclaimer, the term of this patent is extended or adjusted under 35 U.S.C. 154(b) by 0 days.

(21) Appl. No.: 15/667,086

(22) Filed: Aug. 2, 2017

(65) Prior Publication Data

US 2017/0341423 A1 Nov. 30, 2017

Related U.S. Application Data

(63) Continuation of application No. PCT/EP2015/054201, filed on Feb. 27, 2015.

(30) Foreign Application Priority Data

Feb. 2, 2015 (DE) ..... 10 2015 201 776

(51) Int. Cl.
*B41J 2/165* (2006.01)
*B41J 25/34* (2006.01)

(52) U.S. Cl.
CPC ..... *B41J 2/16517* (2013.01); *B41J 2/16508* (2013.01); *B41J 2/16538* (2013.01);
(Continued)

(58) Field of Classification Search
CPC ..... B41J 2/16517; B41J 2/16544; B41J 2/16538; B41J 2/16585; B41J 2/16535; B41J 25/34; B41J 2/16508; B41J 2/16588
See application file for complete search history.

(56) References Cited

U.S. PATENT DOCUMENTS 4,940,998 A 7/1990 Asakawa
6,272,986 B1 8/2001 Hess
(Continued)

FOREIGN PATENT DOCUMENTS

CN 101353495 A 1/2009
CN 102947100 A 2/2013
(Continued)

*Primary Examiner* — Yaovi M Ameh
(74) *Attorney, Agent, or Firm* — Laurence A. Greenberg; Werner H. Stemer; Ralph E. Locher

(57) ABSTRACT

A single-pass inkjet printer contains a track for guiding a printing medium in the Y direction, a plurality of printing head modules which are arranged one behind the other in the Y direction and a respective plurality of printing heads which extends in the X direction transversely over the track, and a printing region in which the printing head modules can be mounted in a respective printing position in an upright manner in the Z direction and in a reversibly insertable and removable manner along the Z direction. The single-pass inkjet printer further contains a storage region in which a number of printing head modules are mounted in a storage position in an upright manner substantially in the Z direction and in a reversibly insertable and removable manner along the Z direction. The printing heads of printing head modules set in the storage position are received in a protective cover.

17 Claims, 8 Drawing Sheets

(52) U.S. Cl.
CPC ..... *B41J 2/16544* (2013.01); *B41J 2/16588* (2013.01); *B41J 25/34* (2013.01); *B41J 2/16535* (2013.01); *B41J 2/16585* (2013.01)

(56) References Cited

U.S. PATENT DOCUMENTS

| | | | | |
|---|---|---|---|---|
| 7,578,578 | B2 | 8/2009 | Akahane | |
| 9,032,260 | B2 | 5/2015 | Petrov | |
| 9,346,298 | B2 | 5/2016 | Van Der Zwan | |
| 9,365,031 | B2 | 6/2016 | Koga | |
| 9,369,153 | B2 | 6/2016 | Petrov | |
| 9,564,929 | B2 | 2/2017 | Petrov | |
| 2004/0041876 | A1 | 3/2004 | Uchida et al. | |
| 2009/0025605 | A1 | 1/2009 | Ishimaru et al. | |
| 2011/0149003 | A1 | 6/2011 | Kondo | |
| 2012/0092403 | A1 | 4/2012 | Profaca et al. | |
| 2012/0120150 | A1* | 5/2012 | Ando | B41J 2/165 347/22 |
| 2012/0249699 | A1* | 10/2012 | Sugimoto | C09D 11/40 347/100 |
| 2013/0100207 | A1* | 4/2013 | Van Der Zwan | B41J 25/308 347/37 |
| 2013/0182036 | A1* | 7/2013 | Park | B41J 2/16538 347/30 |
| 2013/0187979 | A1* | 7/2013 | Bernard | B41J 2/16538 347/33 |

FOREIGN PATENT DOCUMENTS

| | | | |
|---|---|---|---|
| EP | 2821231 | A2 | 1/2015 |
| WO | 2011157282 | A1 | 12/2011 |
| WO | 2012157282 | A1 | 7/2014 |
| WO | 2014185451 | A1 | 11/2014 |

* cited by examiner

SINGLE PASS INKJET PRINTER

CROSS-REFERENCE TO RELATED APPLICATION

This is a continuation application, under 35 U.S.C. § 120, of copending international application No. PCT/EP2015/054201, filed Feb. 27, 2015, which designated the United States; this application also claims the priority, under 35 U.S.C. § 119, of German patent application No. DE 10 2015 201 776.1, filed Feb. 2, 2015; the prior applications are herewith incorporated by reference in their entireties.

BACKGROUND OF THE INVENTION

Field of the Invention

The invention relates to a single-pass inkjet printer having a running track for guiding a printing medium in the Y-direction and having a plurality of print head modules which are arranged behind one another in the Y-direction and extend in each case with a plurality of print heads in the X-direction transversely over the running track. The inkjet printer further having a printing region in which the print head modules can be mounted such that they stand upright in a respective printing position substantially in the Z-direction and can be inserted and removed reversibly along the Z-direction.

Whereas, in the case of a conventional inkjet printer, the print heads which are mounted on a carriage spray ink droplets in the transverse direction (also called the X-direction in the following text) line by line onto the medium which is transported in a discontinuous manner in the running direction (also called the Y-direction in the following text). The print heads in the case of a single-pass inkjet printer are mounted in print head modules of the type mentioned at the outset in the transverse direction (X-direction) over the entire width of the printing medium. The printing medium is moved continuously in the running direction (Y-direction). Whereas printing speeds of up to 2 m per minute are achieved in the case of a conventional inkjet printer, printing speeds of up to over 50 m per minute can be achieved by way of a single-pass inkjet printer. For color printing, a plurality of print head modules is mounted behind one another in the running direction in the case of a single-pass inkjet printer. Here, the print head modules are assigned in each case a primary color, in particular cyan, magenta and yellow and possibly black. Print head modules with a special ink are added for special print uses.

A single-pass inkjet printer is suitable, in particular, for industrial use, in the case of which bulk products have to be printed, and it therefore comes down to a high throughput. On account of the high printing speeds, a single-pass inkjet printer is likewise suitable for printing large-area objects. A single-pass inkjet printer is therefore suitable, in particular, for industrial applications of the furniture or ceramic industry, where floor coverings, such as laminates or ceramic tiles, worktops, moldings or the like are to be provided with a decoration. A very wide variety of inks are used here, which are resistant, for example, with respect to a later protective coating.

In comparison with conventional printing methods, such as gravure printing, the single-pass inkjet printer is also used precisely in the case of small batch sizes where the production of an impression roll is not worthwhile. In contrast, a single-pass inkjet printer also makes individualization of the decoration and what are known as "impossible" decorations possible which cannot be achieved by way of rolls. The single-pass inkjet printer is not restricted to a continuous repetition of a printing pattern or repeating pattern, as is the case in rotary printing.

A print head module for a single-pass inkjet printer reaches dimensions of more than 1 m in the transverse direction and vertically, there being a tendency toward even greater printing widths and therefore to a further increase in the dimensions. The individual print heads which are combined in a print head module in each case have widths of up to several tens of centimeters. Here, resolutions of up to 600×600 dpi (dots per inch) and more are achieved. Here, several thousand individual printing nozzles are contained per print head. Accordingly, a plurality of print heads is arranged in the print head module, which print heads for their part in each case contain a multiplicity of printing nozzles. In particular, the print head module per se extends in the transverse direction (X-direction) over the entire printing width or over the entire width of the printing medium.

Positional deviations of a few micrometers (μm) are visible with the human eye in a printed image. At the abovementioned resolutions, the individual printing nozzles of a print head lie only a few tens of μm apart from one another. The size of an image or printer dot itself is in the range of 10 μm. It can be seen that, in the case of a single-pass inkjet printer having a plurality of print head modules which are arranged behind one another in the running direction (Y-direction) of the medium, an adjustment of the print heads in the micrometer range becomes necessary, in order to produce a high-quality printed image. The adjustment of a print head module in a single-pass inkjet printer is therefore complicated. The position of the print heads has to be detected, for example, by optical microscope and has to be set manually in a complicated manner. The construction of a single-pass inkjet printer is therefore comparatively laborious. An adjustment also has to be carried out after each exchange of a print head module. This leads to an unnecessary extension of the downtimes.

International patent disclosure WO 2012/157282 A1, corresponding to U.S. Pat. Nos. 9,564,929, 9,369,153, 9,160,372, 9,022,260, and discloses a single-pass inkjet printer of the type mentioned at the outset. In this document, the print head modules can be inserted in a suspended, gravity-oriented orientation in the vertical direction (which corresponds to the Z-direction in the present case) into the printing position, in which they are fixed on the unit. The print head modules are lifted jointly in a suspended orientation in the vertical direction (Z-direction) by a lifting/lowering apparatus out of the printing position, in which they are fixed on the unit, on the single-pass inkjet printer, for example for the purpose of maintenance or exchange. In the printing position, in which they are fixed on the unit, the print head modules are mounted so as to substantially stand upright with regard to the vertical direction. In the present case, the wording "substantially" also includes the fact that, in the case of an arcuate course of the printing medium, individual print head modules stand upright in an inclined manner by a polar angle with respect to the Z-direction in their printing position, in which they are fixed on the unit, with the result that the print heads are oriented in each case parallel to the printing medium, in particular also in the Y-direction. In the lifted out position, a cleaning module can be moved in below the print head modules, into which cleaning module the print head modules are subsequently lowered.

Similar single-pass inkjet printers are also known from U.S. patent publication Nos. 2012/0092403 A1 and US 2011/0149003 A1.

In the case of a suspended arrangement of the print head modules, as disclosed for the single-pass inkjet printer in accordance with international patent disclosure WO 2012/157282 A1, gravity which acts on the centroid leads to automatic orientation of the freely movable print head module. As a result, there is already rough positioning with respect to the later printing position, in which it is fixed on the unit, when a suspended print head module is inserted into the single-pass inkjet printer. In particular, the suspended orientation during the insertion is utilized for automatic adjustment of the print head module into the printing position, in which it is fixed on the unit, to which end open bearing elements are provided on the single-pass inkjet printer, into which open bearing elements corresponding bearing pieces of the print head module sink under exact orientation while being lifted in. Manual subsequent adjustment is no longer necessary. The lifting in and out of print head modules is simple in comparison with other single-pass inkjet printers, with the result that unnecessary down times are avoided.

SUMMARY OF THE INVENTION

The invention is based on the object of achieving a service life which is as long as possible for a single-pass inkjet printer of the type mentioned at the outset.

According to the invention, the object is achieved by virtue of the fact that the single-pass inkjet printer of the type mentioned at the outset additionally contains a storage region, in which a number of print head modules can be mounted such that they stand upright in a respective storage position substantially in the Z-direction (approximately vertical direction) and can be inserted and removed reversibly along the Z-direction, the print heads of print head modules which are set into the storage position being received in a protective cover.

Here, the invention proceeds in a first step from the consideration that the print head modules of the specified single-pass inkjet printer can be lifted in and out comparatively simply substantially in the vertical direction (Z-direction) on account of their upright arrangement in the printing position, without a readjustment being required. It is therefore possible to provide an additional storage region for the print head modules in the single-pass inkjet printer themselves in a manner which is spaced apart from the printing region, in which storage region individual print head modules are stowed in a protected manner, if no printing operation takes place or the respective print head module is not required for printing. To this end, a protective cover is included at the storage position for each print head module, in which protective cover the print heads are received for protection against external influences. In particular, the print heads of the print head modules which are received in the protective cover are flushed with a protective gas. Oxidation and/or drying and clogging of the printing nozzles are/is avoided by way of the use of a corresponding protective gas. The protective gas is selected, in particular, in a manner which is dependent on the ink which is used. The printing nozzles are preferably flushed with a protective gas at a temperature between 15° C. and 30° C., advantageously between 20° C. and 24° C., which protective gas contains a relative humidity of from 30% to 80%, advantageously of from 45% to 55%.

In a second step, the invention recognizes that an easy change of the print head modules between the printing position and the storage position is made possible when a mounting which corresponds to the printing position is provided in the storage region. Therefore, the print head modules are mounted in the storage region, in a manner which corresponds to the printing region, such that they stand upright in a respective storage position likewise substantially in the Z-direction and can be inserted and removed reversibly along the Z-direction. In order to change a print head module from its printing position into the storage position, the print head module is lifted out substantially in the vertical direction from the printing position or from the corresponding mounting and is moved in a suspended and therefore gravity-oriented manner into the storage position. There, it is correspondingly lifted in while reaching its storage position. In a reversed sequence, a likewise simple change of the print head module out of its storage position in the storage region into its printing position in the printing region takes place.

The storage region is offset in the X-direction or in the Y-direction with respect to the printing region. In particular, a lifting/lowering device is provided which is configured for lifting in and out of the print head modules in the Z-direction and can be moved in the Y-direction and/or in the X-direction along the single-pass inkjet printer. As a result, serial or parallel movement of the individual print head modules between the printing region and the storage region is made possible without a large space requirement.

In one simple refinement, the storage region is offset in the Y-direction with respect to the printing region. Here, the print head modules are moved in series without a change to their sequence by means of a lifting/lowering device in the Y-direction between the printing region and the storage region. An exchange of individual print head modules is preferably made possible in the storage region.

In the present case, an orthogonal coordinate system is very generally used to describe the single-pass inkjet printer, the three spatial directions being denoted by X-direction, Y-direction and Z-direction. The directional specifications which are used relate to the positive space sector. If a component is situated "above" another component along one of the spatial axes, its corresponding axial section is greater. Conversely, the axial section of a component is smaller if it is situated "below" another component with regard to the spatial axis. In the present case, the X-direction is also called the transverse direction. The Y-direction is also called the running direction (of the printing medium). In the assembled printer, the Z-direction corresponds substantially to the vertical direction.

In one advantageous refinement of the invention, the single-pass inkjet printer contains a lifting/lowering device which can be moved in the Y-direction and is configured substantially in the vertical direction for lifting a print head module in and out in a manner which is oriented freely by way of gravity. To this end, mounting aids are preferably provided on each print head module, into which mounting aids corresponding fastening device of the lifting/lowering device engage. The mounting aids are expediently configured as cable fastening devices.

During the lifting in and out, the respective print head module hangs, in particular, in a swinging manner on the lifting/lowering device. Open bearings are advantageously provided in each case for positioning a print head module of the single-pass inkjet printer in the printing region and in the storage region, into which open bearings bearing pieces sink which are arranged correspondingly on the print head module with self-adjusting orientation. Catching devices are preferably configured for self-adjustment on the print head module and on the single-pass inkjet printer, via which catching devices a pre-orientation of the suspended print head module which is oriented by way of gravity takes place with regard to the envisaged printing position or storage position during lifting in. The catching devices in turn are preferably configured with a catching wedge which is received by a corresponding wedge shaft. Here, the catching wedge and the wedge shaft are assigned to the print head module and a frame construction of the single-pass inkjet printer, respectively, or vice versa.

In a further preferred refinement of the single-pass inkjet printer, a cleaning device is arranged in the storage region, which cleaning device contains a number of doctor blade carriers which are assigned in each case to a storage position, can be displaced preferably in the X-direction, and in each case carry a number of doctor blades. In other words, the cleaning device is provided with a doctor blade carrier for each set print head module, by way of the movement of which doctor blade carrier, in particular in the X-direction (transverse direction), the respective print heads are cleaned of dust and dirt residues and ink residues by means of the doctor blades which move along them. In one alternative refinement, the cleaning device and/or the doctor blade carriers are/is configured for moving the doctor blades in the Y-direction. Here, the doctor blades are preferably of wiping, sucking or blowing configuration. The cleaning takes place in the single-pass inkjet printer, in particular, in an automated manner, while the print head modules are set in the respective storage position. To this end, a sensor arrangement is preferably included which indicates the presence of a set print head module for each storage position. The starting operation of the cleaning process is initiated if a presence signal is generated for a storage position by way of the sensor arrangement. External outer cleaning of the print head modules is not required. The intervals for external maintenance of the print head modules can be extended. A drive device for displacing a or each doctor blade carrier, in particular along the X-direction, is expediently included by the cleaning device.

Precisely one doctor blade is expediently assigned on the or each doctor blade carrier for each print head of a set print head module. This makes specific cleaning of each individual print head possible. The displaceability of the doctor blade carrier is to be ensured only for a length which corresponds to the length of an individual print head in the X-direction.

In order to restrict the cleaning function to print head modules which are actually set into the storage position, it is expedient, furthermore, if the cleaning device contains a separate drive unit for displacing in each case one doctor blade carrier at each storage position. The displacement movement then takes place by way of corresponding actuation of the respective drive unit merely for that doctor blade carrier which is situated at the position of a set print head module.

In a further advantageous refinement, the or each doctor blade is guided on the respective doctor blade carrier such that it can be adjusted in the Z-direction between a cleaning position and a distance position, a doctor blade setting device for adjusting in each case one doctor blade between the cleaning position and the distance position being included. The refinement makes it possible to specifically select a print head to be cleaned for a print head module which is set into the storage position, and to subject only the selected print head to cleaning. To this end, the associated doctor blade is adjusted in the Z-direction into the cleaning position, the doctor blade being in contact with the print head or close to said print head, in particular, during the displacement in the X-direction or in the Y-direction. If the doctor blade is adjusted into the distance position, it is spaced apart from the print head in the Z-direction or is spaced apart further with respect to the cleaning position. To this extent, the doctor blade which is adjusted in the distance position does not wipe along the respectively associated print head during a displacement movement of the doctor blade carrier or is further away from the print head in the case of a sucking or blowing configuration. The actuation of the respective doctor blade setting devices takes place, in particular, using signals which separately indicate a contamination or an operational disruption for each print head. A signal of this type is generated, for example, in the control units of the corresponding print head modules, which control units are set up to monitor the functionality of the respective print heads using measured parameters, for example in the ink feed line. As an alternative, the print heads to be cleaned are determined by way of monitoring of the printed image.

The or each doctor blade is expediently positively guided in the cleaning position along a first guide track which preferably extends in the X-direction, and is positively guided in the distance position along a second guide track which preferably extends in the X-direction, the first guide track and the second guide track being connected to one another via a connecting section which extends, in particular, in the Z-direction, and the respective doctor blade setting device being configured for switchable determination of the guide track which is taken. The mechanical configuration permits a displacement of the doctor blade carrier, in particular, in the X-direction, each doctor blade either moving along the first guide track in the cleaning position or along the second guide track in the distance position. By way of adjustment of the doctor blade in the Z-direction in the region of the connecting section, a change between the two guide tracks and therefore a change between the distance position and the cleaning position are made possible for the respective doctor blade.

The or each doctor blade is preferably guided by an engagement element in the first guide track and in the second guide track. Here, furthermore, the doctor blade setting device expediently contains a magnetic element which acts on the respective engagement element in the connecting section. Contactless switching of the respective doctor blades between the guide tracks takes place via the magnetic element. In other words, it does not become necessary to mechanically couple the doctor blade carrier which can be displaced, in particular, in the X-direction to the doctor blade setting device, in order to make switching between the first and the second guide track possible.

The single-pass inkjet printer advantageously additionally contains a maintenance region in a manner which is offset in the X-direction with respect to the storage region, in which maintenance region the print head modules can be stored such that they stand upright in a respective maintenance position substantially in the Z-direction and can be inserted and removed reversibly along the Z-direction. In other words, a mounting which corresponds to the printing position is also provided in the maintenance region for the print head modules which are received. In this way, a simple change of print head modules out of the storage position into the maintenance position and vice versa is possible. In particular, print head modules of this type which have to be subjected, for example, to external maintenance or which are to be replaced in the single-pass inkjet printer are received into the maintenance region, since, for example, a print head module is required for printing with a different ink with regard to color or consistency.

In a further preferred refinement of the single-pass inkjet printer, in each case one storage apparatus which can be displaced in the X-direction is provided in the storage region for the or each print head module, in which storage apparatus a set print head module assumes its storage position, the protective cover being a part of the storage apparatus. Here, the storage region and the maintenance region can expediently be coupled in such a way that the or each storage apparatus with a set print head module can be displaced in the X-direction out of the storage region onto the maintenance region. In other words, a print head module which is set in its storage position on the storage apparatus of the storage region can be displaced together with its bearing in the transverse direction (X-direction) from the storage region onto the maintenance region and vice versa. A lifting/lowering device which acts in the Z-direction is not required for changing a print head module out of its storage position into the maintenance position. The exchange of print head modules is simplified in the storage region. Print head modules which are provided for exchange or for maintenance are displaced with a corresponding bearing between the maintenance region and the storage region. Since the mounting of the print head modules in the storage apparatus once again corresponds to the mounting in the printing region, it becomes possible, in particular, to already pre-adjust the print head modules which are provided for installation into the single-pass inkjet printer externally with respect to a reference position.

The displaceable storage apparatus preferably contains the above-described open bearings, into which bearing pieces sink which are arranged correspondingly on the print head module during lifting in with self-adjusting orientation. The catching devices are further preferably configured for self-adjustment on the displaceable storage apparatus, which catching devices, in interaction with catching devices on the print head module, carry out a pre-orientation of a suspended print head module which is oriented by way of gravity with regard to the envisaged printing position or storage position and, in the present case, the maintenance position. As has already been described, the catching device is expediently configured with a catching wedge which is received by a corresponding wedge shaft.

The storage region and the maintenance region advantageously in each case have guide elements for guiding the or each storage apparatus, it being possible for the guide elements of the storage region and the guide elements of the maintenance region to be coupled to one another in order to form a displacement track which is continuous in the X-direction. After the coupling has taken place, the print head module which is provided for exchange or for maintenance is displaced, with the mounting storage apparatus being carried along with it, along the guide elements in a continuous displacement track out of the storage region into the maintenance region and vice versa. In other words, the storage apparatus per se can be displaced in a guided manner along the displacement track via the coupled guide elements between the storage region and the maintenance region.

The maintenance region is expediently configured as a mobile maintenance carriage. If a print head module is to be exchanged, is to be removed for maintenance of the single-pass inkjet printer, or is to be fed to the storage region, the maintenance carriage is guided laterally onto the storage region and is coupled to the latter, in particular mechanically. Subsequently, the exchange of the print head module is performed by way of displacement of the storage apparatus which mounts the print head module.

In a further advantageous refinement, the maintenance region contains a stop buffer and/or a fixing element for a or each storage apparatus which is moved in. The stop buffer prevents a mechanical offset of a set print head module in its mounting, which mechanical offset might possibly be an undesired result of an exchange which is too rapid. A storage apparatus which is moved in is fixed in the maintenance region by way of the fixing element, with the result that there is secure movement of the print head module to another location, in particular by a mobile maintenance carriage. A sensor arrangement is advantageously also included in the maintenance region, which sensor arrangement senses or detects the presence of a set print head module and/or storage apparatus which is moved in.

Other features which are considered as characteristic for the invention are set forth in the appended claims.

Although the invention is illustrated and described herein as embodied in a single-pass inkjet printer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
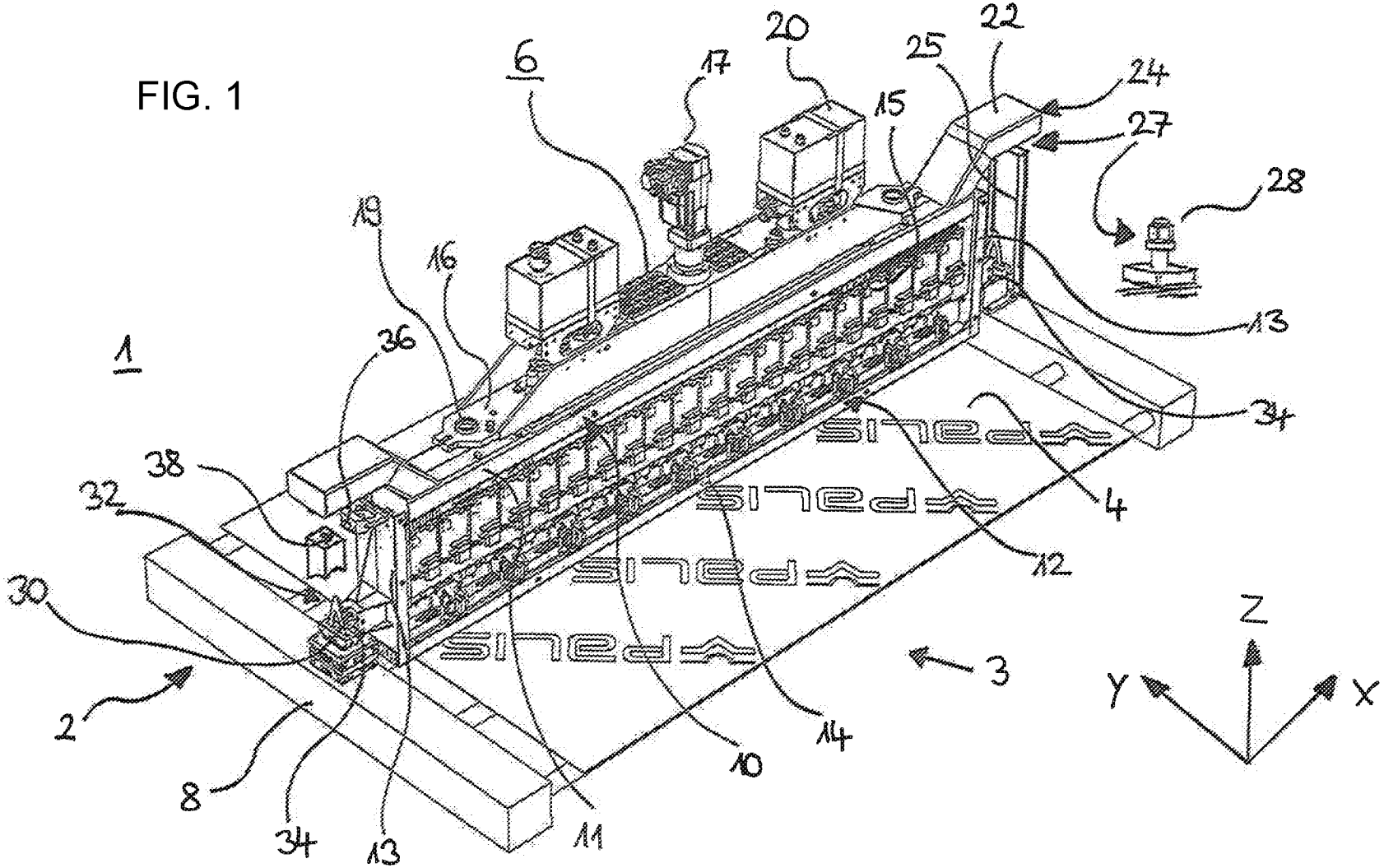
FIG. 1 is a diagrammatic, perspective view of a detail of a printing region of a single-pass inkjet printer with a print head module which is set into a printing position, in which it is fixed on the unit, and according to the invention.

Referring now to the figures of the drawings in detail and first, particularly to FIG. 1 thereof, there is shown a printing region 2 in a three-dimensional illustration for a single-pass inkjet printer 1. For orientation, an orthogonal coordinate system with the three spatial directions X, Y and Z is illustrated.

A printing medium 4 is moved continuously in the Y-direction (running direction) along a running track 3 during a printing operation. A print head module 6 extends in the X-direction (transverse direction) over the entire printing medium 4, which print head module 6 is mounted fixedly on the unit on a frame construction 8 of the single-pass inkjet printer 1 in an oriented printing position such that it stands upright substantially in the Z-direction (vertical direction).

The print head module 6 has a load-bearing frame 10 which extends with a cross-member 11 in the X-direction transversely over the printing medium 4. A transverse bracket 12 is mounted in a suspended manner via two side cheeks 13 on the cross-member 11 of the load-bearing frame 10. Here, the mounting permits swinging of the transverse bracket 12 about a swing axis which is oriented in the X-direction. The swing axis runs, in particular, through the cross-member 11 or just below the cross-member 11, with the result that the centroid of the transverse bracket 12 is situated below the cross-member 11 in the Z-direction. If the print head module 6 is lifted out vertically in the Z-direction, the transverse bracket 12 is aligned in an oriented manner by way of gravity below the cross-member 11.

A multiplicity of print heads 14 are arranged on the transverse bracket 12 along the X-direction over the printing medium 4. Control boards 15 and supply lines for operating materials or for supplying electric energy are mounted on the load-bearing frame 10. As a result, the weight of components of the print head module 6 which acts on the print heads 14 is reduced. A weight-induced deformation of the transverse bracket 12 and therefore an undesired displacement of the print heads 14 with respect to the adjusted printing position are prevented. This allows the dimension of the print head module 6 along the X-direction to be increased in comparison with the prior art. The transverse bracket 12 of the single-pass inkjet printer 1 which is shown in FIG. 1 has, for example, a length of over 2.5 m in the X-direction.

A coupling module 16 can be coupled and decoupled on the cross-member 11 of the load-bearing frame 10 via a multiple coupling which is not shown in detail. Here, the multiple coupling is operated via an electric motor 17 which is placed onto the coupling module 16. For example, the motor 17 actuates screw connections, via which the coupling module 16 and the cross-member 11 are coupled to one another with simultaneous connection of supply lines, control lines and/or electric lines. During coupling, the cross-member 11 and the coupling module 16 approach one another. During the decoupling, the cross-member 11 and the coupling module 16 move away from one another. The coupling module 16 makes simple connection of the print head module 6 to the supply and control lines of the single-pass inkjet printer 1 possible.

In order to lift the print head module 6 out and in the Z-direction (vertical direction), furthermore, mounting aids 19 which are configured, for example, as cable fastening devices are arranged on the coupling module 16. Cable ends of a lifting/lowering device (not shown) are coupled on the mounting aids 19. The print head module 6 is raised or lowered for installation or dismantling by way of the cable length being changed by means of the lifting/lowering device. Furthermore, two ink reservoirs 20 are mounted on the coupling module 16, the print heads 14 being supplied with ink during the printing operation via the supply lines which are likewise coupled by the multiple coupling.

The cross-member 11 of the print head module 6 has two carrying arms 22 which extend laterally in the X-direction as far as over the frame construction 8. The carrying arms 22 and therefore the load-bearing frame 10 of a load-bearing construction 25 which is configured on both sides, which load-bearing frame 10 carries the substantial weight of the print head module 6, are placed via a supporting device 24 which cannot be seen in greater detail here, which load-bearing construction 25 for its part is mounted on the frame construction 8 of the single-pass inkjet printer 1. For reasons of clarity, merely the right-hand load-bearing construction 25 in FIG. 1 is illustrated here.

The print head module 6 which is deposited on the load-bearing constructions 25 via the supporting device 24 is already aligned in accordance with the provided printing position in a manner which is oriented by way of gravity. To this end, the carrying arms 22 are guided vertically upward with regard to the cross-member 11. Accordingly, the print head module 6 can be lifted in and out of the single-pass inkjet printer 1 easily in the vertical direction. The supporting devices 24 are deposited on the carrying arms 22, in each case on a rest 27 of the load-bearing construction 25. The rest 27 is shown on an enlarged scale in a detailed view. Each rest 27 contains a planar supporting face 28 which is mounted in a rotatably movable manner in a ball joint. The supporting face 28 of the rest 27 is oriented in the ball joint by way of the weight of the deposited load-bearing frame 10, with the result that there is always a flat contact between the supporting device 24 and the rest 27, even in the case of an inclined angle of the print head module 6, which inclined angle is possibly desired in the printing position.

Bearing pieces 30 are mounted in each case at the lower ends of the side cheeks 13 of the transverse bracket 12 which is suspended in a swinging manner. When the print head module 6 which has already been pre-oriented by way of gravity is lifted in, the bearing pieces 30 are precision adjusted by respective catching device 32 with respect to corresponding bearing seats of open bearings 34. Here, the catching devices 32 are configured in each case as a combination of a catching wedge and a wedge shaft which receives the catching wedge. The bearing pieces 30 are configured, for example, as ball pivots. To this end, the bearing seats of the open bearings 34 which are arranged on both sides of the running track 3 on the frame construction are preferably configured as conical, spherical or prismatic seats. Here, one of the open bearings 34 is further preferably configured as a fixed bearing with regard to the X-direction, and the other one of the open bearings 34 is configured as a floating bearing. As a consequence, for example, a bearing combination with a spherical or conical seat on one side and with a prismatic seat on the other side of the print head module 6 is formed. A prismatic seat which extends in the X-direction permits displaceability in the X-direction, while the Y-coordinate and the Z-coordinate are fixed. A longitudinal offset of the print head module 6 in the X-direction on account of thermal cycling is absorbed in a defined manner by way of a fixed/floating bearing combination of this type in the open bearings 34. In particular, a creeping offset of the print head module in the X-direction is prevented, since both a longitudinal expansion and a longitudinal contraction are absorbed in a defined manner by way of always the same one of the bearings 34, namely by way of the floating bearing.

In order to fix the printing position, in which it is fixed on the unit, of the print head module 6 which is received in the single-pass inkjet printer 1, a stop piece 36 is mounted on a side cheek 13 of the transverse bracket 12. The stop piece 36 is defined with respect to a stop face 38 of the frame construction 8. When the print head module 6 is lifted in, the inclination or polar angle of the print head module 6 is defined in the printing position, in which it is fixed on the unit, via the stop piece 36 and the stop face 38.

Figure 2:
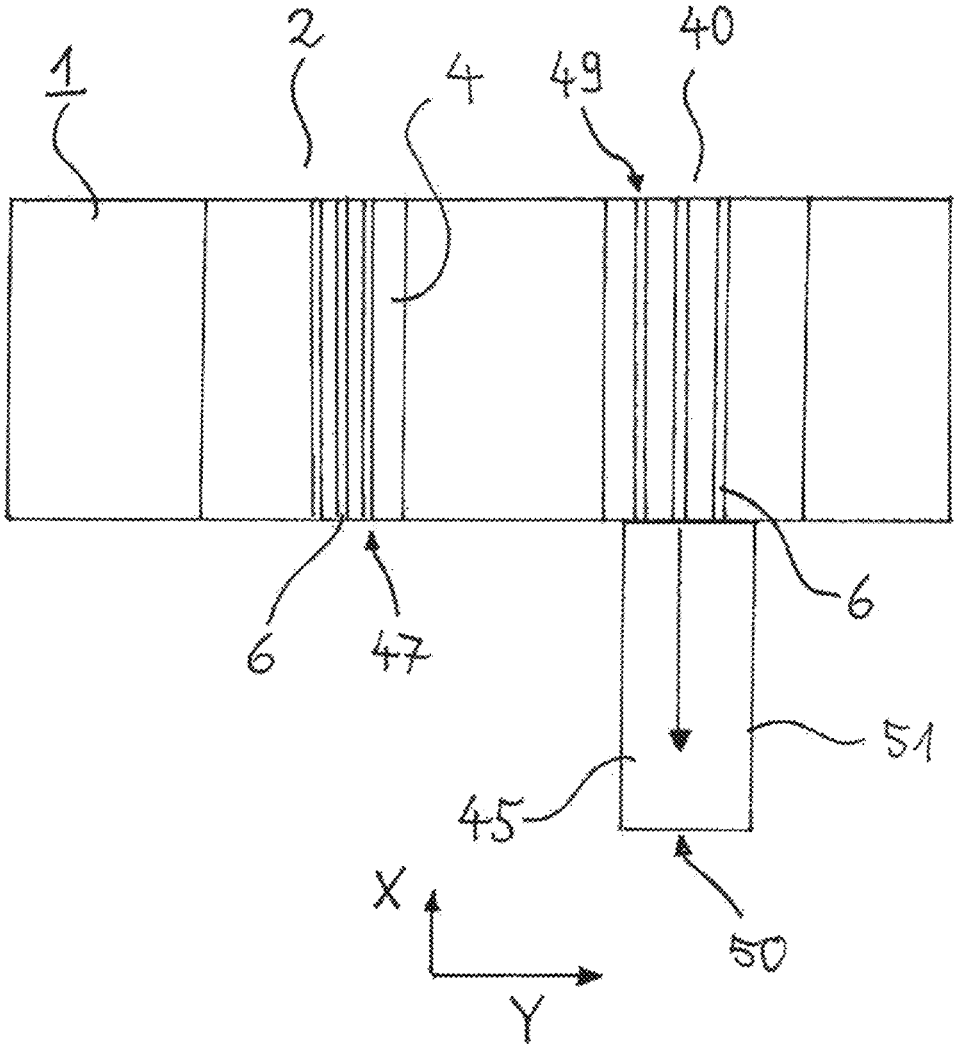
FIG. 2 is an illustration showing the single-pass inkjet printer which has a printing region, a storage region and a maintenance region.

FIG. 2 diagrammatically shows a plan view from above of the entire construction of a single-pass inkjet printer 1 in accordance with FIG. 1. The printing region 2 which is shown in FIG. 1 can be seen in the plan view, three print head modules 6 being lifted in each case at their corresponding printing position 47 by way of example behind one another in the Y-direction (running direction) of the printing medium 4. Here, each of the print head modules 6 which are lifted into the printing region 2 is provided for printing the printing medium 4 with a specific color or ink.

In a manner which is spaced apart in the Y-direction from the printing region 2, furthermore, the single-pass inkjet printer 1 has a storage region 40, in which print head modules 6 can be introduced, for cleaning purposes or for protecting the print heads, out of the printing region 2 by means of a lifting/lowering device (not shown here) after being lifted out in the vertical direction, by way of movement in the Y-direction and subsequent lowering. In the present case, three print head modules 6 are lifted in their respective storage position 49 into the storage region 40.

For external maintenance or for exchanging individual print head modules 6, furthermore, the single-pass inkjet printer 1 has a maintenance region 45 which is arranged laterally of the storage region 40 in the X-direction. The maintenance region 45 is configured, for example, as a mobile maintenance carriage 51 which is configured, in particular, such that it can be moved in the Y-direction, and can be coupled to the storage region 40. Individual print head modules 6 are changed between the storage region 40 and the maintenance region 45 by way of being pushed in or out laterally. The print head modules 6 which are situated in the respective maintenance position 50 in the maintenance region 45 are moved to another location by way of movement of the maintenance carriage 51, for the purpose of an inspection or an exchange.

Figure 3:
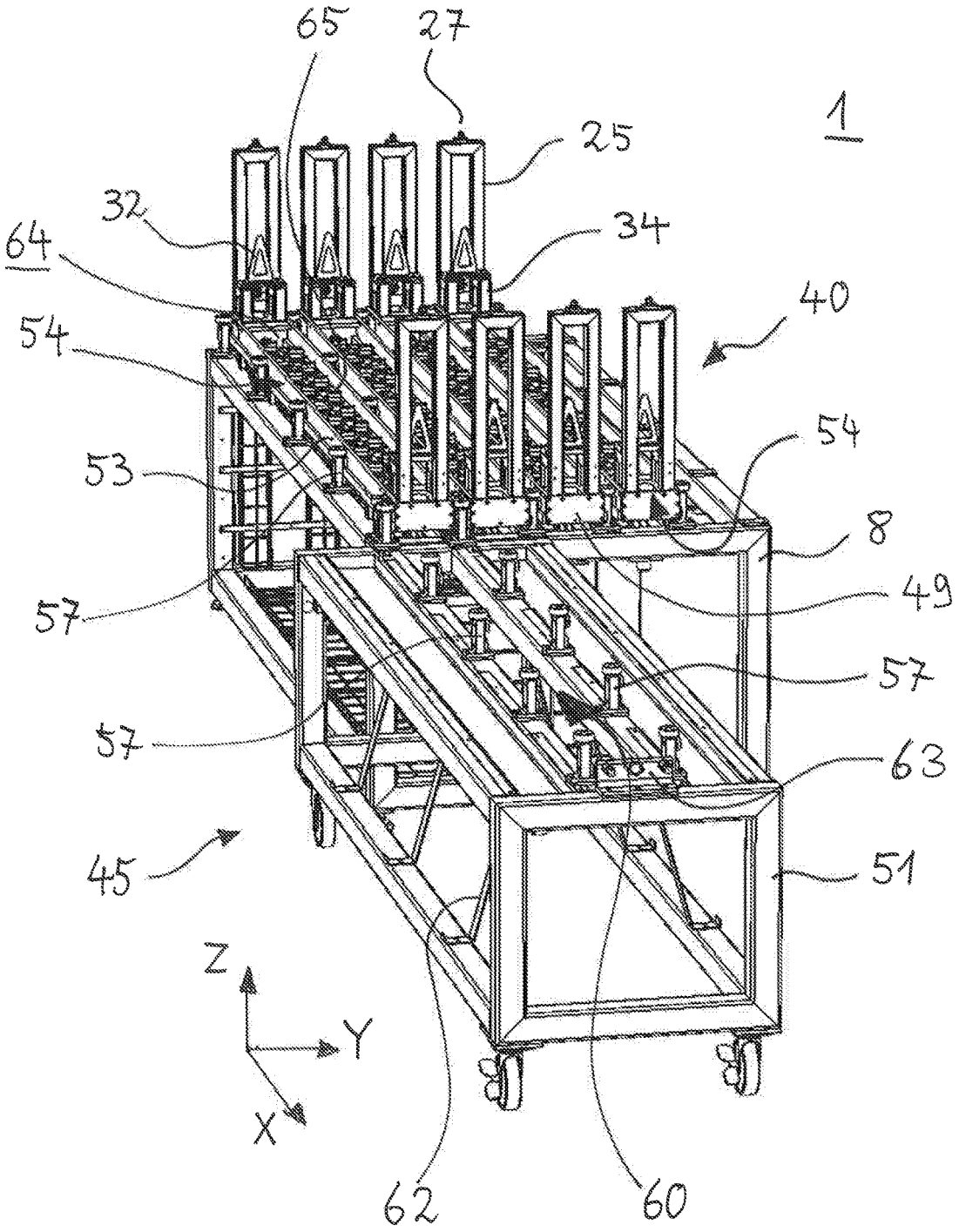
FIG. 3 is a partial, perspective view of the storage region and the maintenance region of the single-pass inkjet printer, a storage apparatus which can be displaced between the storage region and the maintenance region being included.

FIG. 3 shows a three-dimensional view of the storage region 40 and the maintenance region 45 of the single-pass inkjet printer 1 in one exemplary refinement. The maintenance region 45 is configured as a movable maintenance carriage 51. In the situation which is shown, a print head module 6 is lifted neither into the storage region 40 nor into the maintenance region 45.

A frame construction 52 can be seen on the storage region 40. A protective cover 53 for covering the print heads of received print head modules 6 is configured at each storage position 49 of the storage region 40. The protective cover 53 is in each case a fixed constituent part of a storage apparatus 54 which can be displaced in the X-direction and for its part has in each case the load-bearing constructions 25 which are configured in accordance with the printing region 2 (see FIG. 1), including the rests 27 and the catching devices 32. The print head modules 6 which are lifted in the vertical direction out of the printing region 2 or out of their printing position 47 there can correspondingly be lifted into the respective storage apparatus 54 with corresponding orientation. Here, the supporting devices 24 of the print head modules 6 accordingly lie on the corresponding rests 27 of the respective storage apparatuses 54. The bearing pieces 30 of print head modules 6 which have been lifted in are positioned in the corresponding open bearings 34. Merely stop faces 38 for inclining print head modules 6 which have been lifted in via their corresponding stop pieces 36 are not provided in the storage apparatuses 54. Print head modules 6 which have been lifted in stand upright in a manner which is oriented in the vertical direction in the respective storage position 49.

Each of the four storage apparatuses 54 in the exemplary embodiment which is shown is guided on the frame construction 52 by means of guide elements 57 such that it can be displaced in the X-direction. The guide elements 57 of the storage region 40 can be coupled with corresponding guide elements 57 of the maintenance carriage 51 to form a continuous displacement track 60 along the X-direction if the maintenance carriage 51 is positioned correspondingly in the Y-direction with respect to the storage region 40. In addition to the guide elements 57, the maintenance carriage 51 has retaining brackets 62 which serve to store cover plates of a received print head module 6. The non-illustrated cover plates of this type are mounted on the print head modules 6 in accordance with FIG. 1 on the sides which are open there in order to cover the interior space and for mechanical stabilization. This can also be gathered, in particular, from FIGS. 5 and 6 (see designation 66).

Via the jointly formed continuous displacement track 60, a storage apparatus 54 with a print head module 6 which is lifted in can be displaced out of the storage region 40 into the maintenance region 45 and vice versa. Each print head module 6 which is lifted in can be pushed out or in separately. In order to limit the displacement movement of a storage apparatus 54, a stop buffer 63 is mounted on the end side of the maintenance carriage 51.

Furthermore, a cleaning device 64 is configured in the storage region 40 of the single-pass inkjet printer 1 which is shown. Here, the cleaning device 64 has a plurality of individual doctor blades 65 which are directed from below against the print heads of a set of print head modules 6. The doctor blades 65 are likewise part of the displaceable storage apparatus 54 and can be displaced in the X-direction in a to and fro movement via a doctor blade drive device (designation 87 in FIG. 8).

Figure 4:
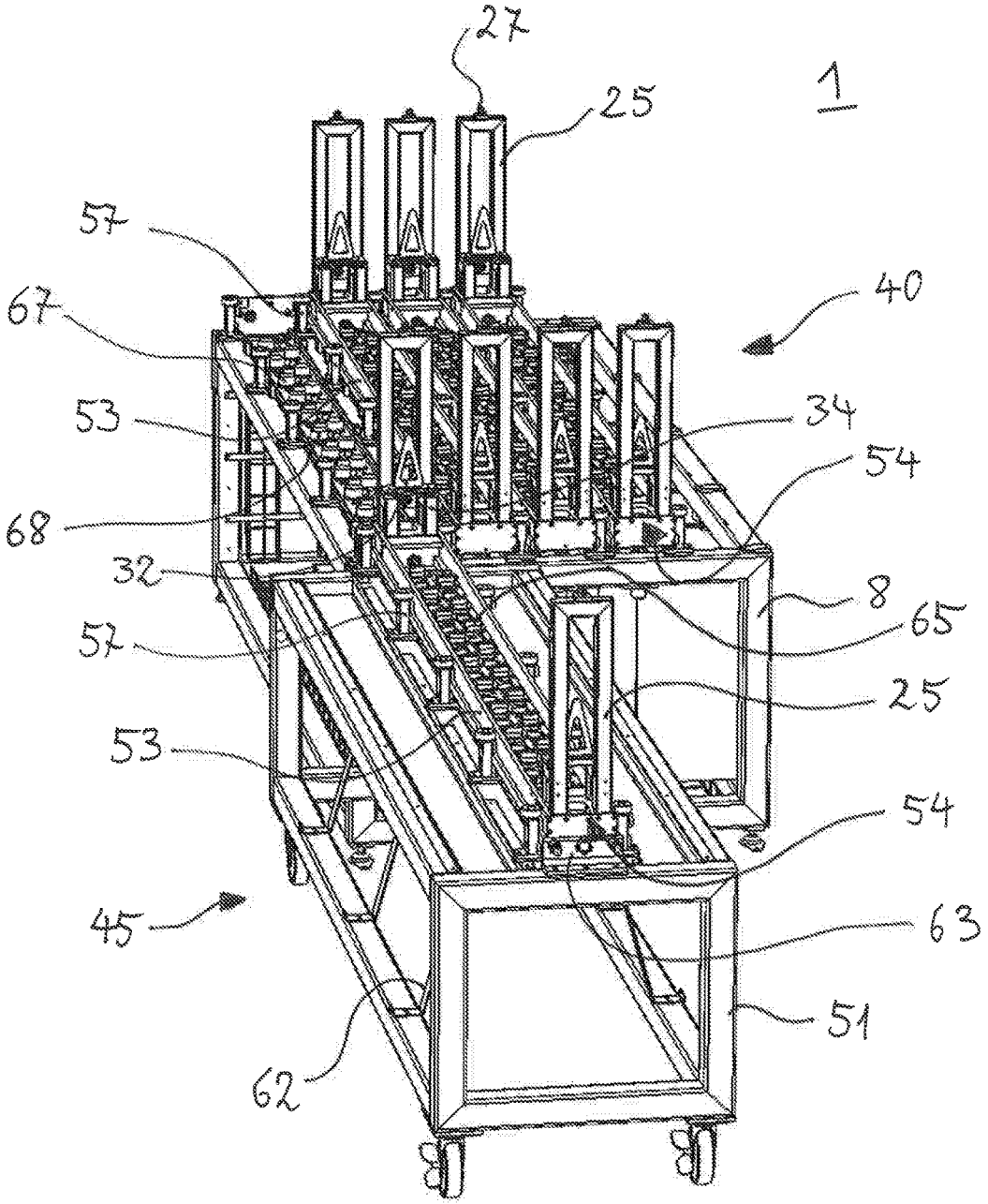
FIG. 4 is partial, perspective view of the storage region and the maintenance region of the single-pass inkjet printer in accordance with FIG. 3, the displaceable storage apparatus being displaced onto the maintenance region.

FIG. 4 shows the storage region 40 and the maintenance region 45 of the single-pass inkjet printer 1 in accordance with FIG. 3 in a three-dimensional view. In comparison with FIG. 3, however, in FIG. 4 one of the storage apparatuses 54 is then pushed out in the X-direction along the displacement track 60 which is formed by means of the guide elements 57 of the storage region 40 and of the maintenance region 45 onto the maintenance carriage 51. Here, the storage apparatus 54 which is pushed out comes into contact with the stop buffer 63 of the maintenance carriage 51. It can be seen, in particular, that the storage apparatus 54 including the load-bearing constructions 25, the catching device 32, the open bearings 34 and the doctor blade 65 is displaced onto the maintenance carriage 51. The doctor blades 65 are mounted, in particular, in the interior of the protective cover 53.

Figure 5:
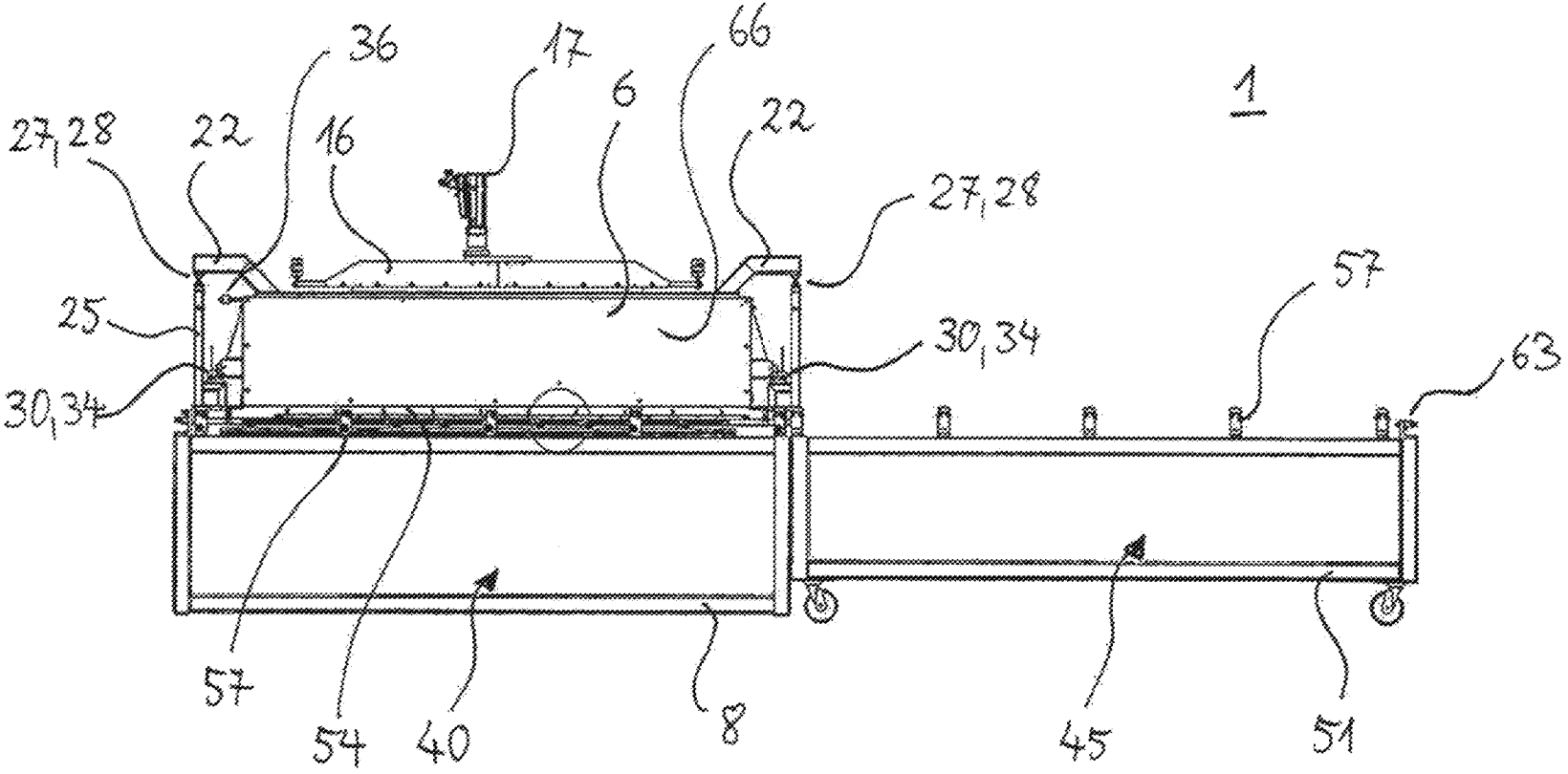
FIG. 5 is a plan view of the storage region and the maintenance region of the single-pass inkjet printer, the print head module being set into a displaceable storage apparatus in the storage region.
Figure 6:
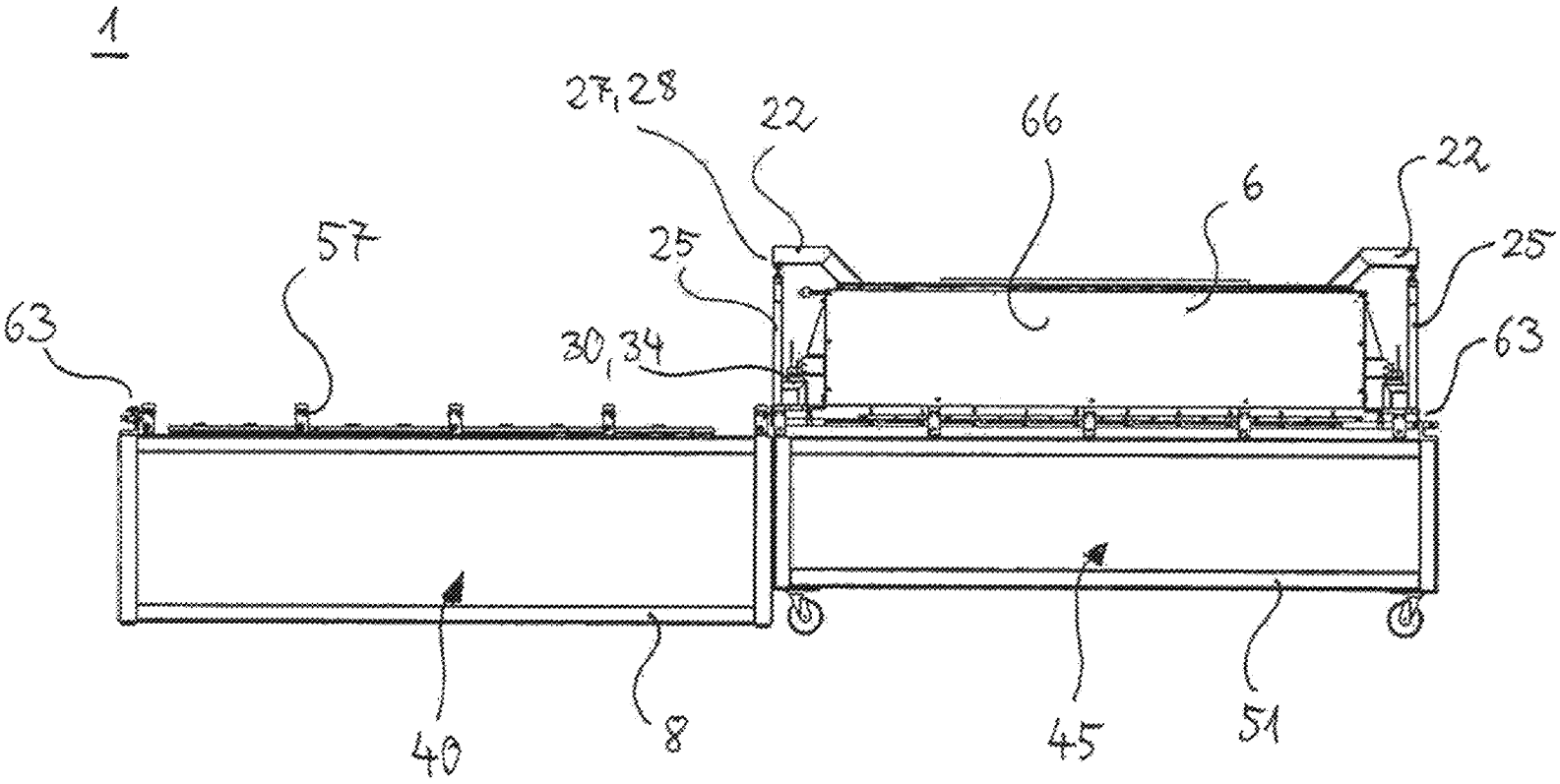
FIG. 6 is a plan view of the storage region and the maintenance region of the single-pass inkjet printer in accordance with FIG. 5, the storage apparatus with a set print head module being displaced onto the maintenance region.

FIGS. 5 and 6 show the storage region 40 and the maintenance region 45 of the single-pass inkjet printer 1 in accordance with FIGS. 3 and 4 from another perspective, namely from a viewing direction in the Y-direction (running direction). In contrast to FIGS. 3 and 4, however, a print head module 6 in accordance with FIG. 1 is then lifted into a respective storage apparatus 54. In particular, the lateral carrying arms 22, the coupling module 16, the motor 17 and the stop piece 36 of the print head module 6 can be seen. The rests 27 of the print head module 6 lie on the supporting face 28 of the load-bearing constructions 25 which are arranged on both sides. The bearing pieces 30 are received in the corresponding open bearing 34 of the storage apparatus 54. The print head module 6 is shown with inserted covering plates 66 in FIGS. 5 and 6.

In FIG. 5, the print head module 6 is positioned with the storage apparatus 54 in the storage region 40. In FIG. 6, the storage apparatus 54 is pushed out with the received print head module 6 onto the maintenance carriage 51. The contact with respect to the stop buffer 63 can be seen.

Figure 7:
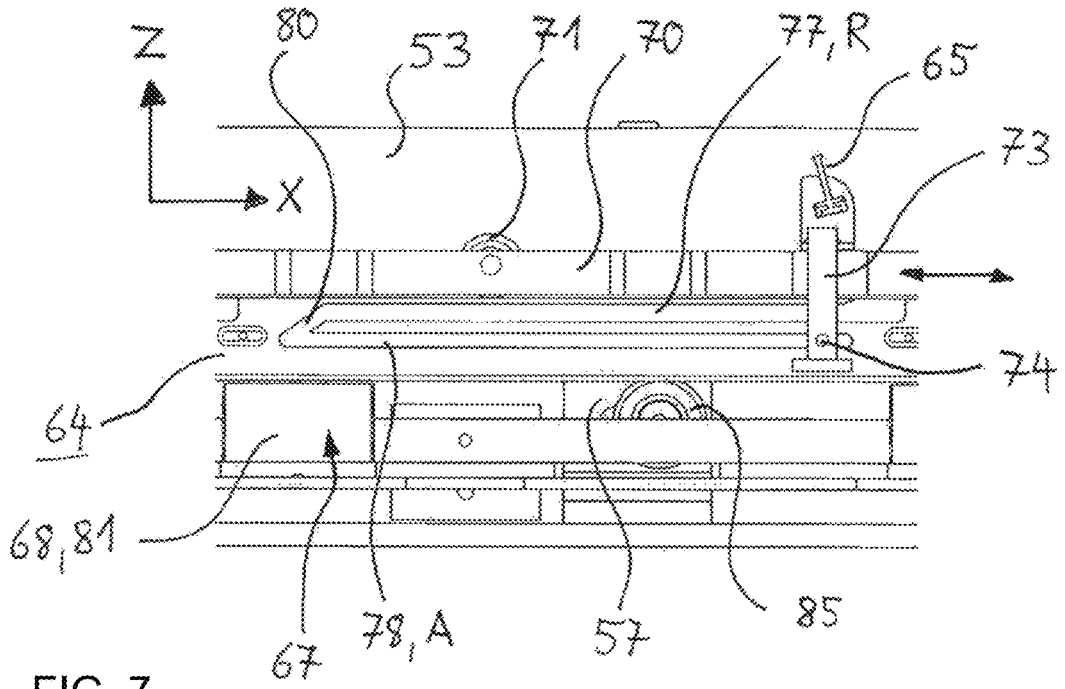
FIG. 7 is an illustration showing a cleaning device with a displaceable doctor blade carrier in an enlarged detail view of the storage region of the single-pass inkjet printer.

FIG. 7 shows, partially in cross section and partially in plan view, a detail of the cleaning device 64. In the detail, in particular, the mounting of the doctor blades 65 for cleaning the print heads of set print head modules 6 can be seen.

Each doctor blade 65 of the cleaning device 64 is assigned a doctor blade setting device 67. Each doctor blade setting device 67 has a setting element 68 which is configured, for example, as a magnetic element 81. The doctor blades 65 are mounted jointly on a doctor blade carrier 70 which can be displaced in the X-direction in a to and fro movement. Corresponding guide rollers 71 to this end can be seen. With respect to the doctor blade carrier 70, the doctor blades 65 are in turn mounted in each case by a carrying element 73 such that they can be displaced in the Z-direction. To this end, the carrying element 73 of each doctor blade 65 is guided by means of a respective engagement element 74 in each case either in a first guide track 77 which extends in the X-direction or in a second guide track 78 which extends in the X-direction. Both guide tracks 77, 78 are coupled to one another via a connecting section 80 which extends substantially in the Z-direction. The doctor blade carrier 70 moves in the X-direction relative to the components of the cleaning device 64 during a cleaning operation.

In the present case, the doctor blade 65 which is shown is situated in a distance position A, the engagement element 74 being guided in the second guide track 78. If the doctor blade carrier 70 is moved in the X-direction, the doctor blade 65 remains at a distance position with regard to the Z-direction with respect to the print head 14 of a set print head module 6. The doctor blade 65 is spaced apart further from the respectively assigned print head 14 than in the cleaning position.

The carrying element 73 is prestressed in the Z-direction with respect to the doctor blade carrier 70. If the carrying element 73 is aligned with the setting element 68 during the cleaning movement, without said setting element 68 being activated, the engagement element 74 is pulled upward along the connecting section 80 on account of the mechanical prestress. During a return movement of the doctor blade carrier 70, the doctor blade 65 is then situated in the cleaning position R, the engagement element 74 being guided in the first guide track 77. In other words, the cleaning position R is the mechanically predefined position of the doctor blade 65. If a doctor blade 65 is to be moved into the distance position A, the setting element 68 or, by way of example, the magnetic element 81 is activated during the cleaning movement if the carrying element 73 is aligned. In this way, the engagement element 74 is moved via the connecting section 80 into the second guide track 78 counter to the mechanical prestress or remains there, with the result that the distance position A is given during the cleaning movement of the doctor blade carrier 70 (a to and fro movement in the X-direction). The activated magnetic element 81 acts on a correspondingly ferrimagnetic or ferromagnetic material element on the carrying element 73, counter to the mechanical prestress.

The cleaning device 64 which is shown makes it possible to switch each doctor blade 65 separately between a cleaning position R, in which the doctor blade 65 is close to the print head 14 of a set print head module 6, preferably touches the print head 14, and a distance position A, in which the doctor blade 65 is spaced apart further from the print head 14. If each print head 14 of a set print head module 6 is assigned a doctor blade 65, it becomes possible to actuate each print head 14 separately for cleaning.

Figure 8:
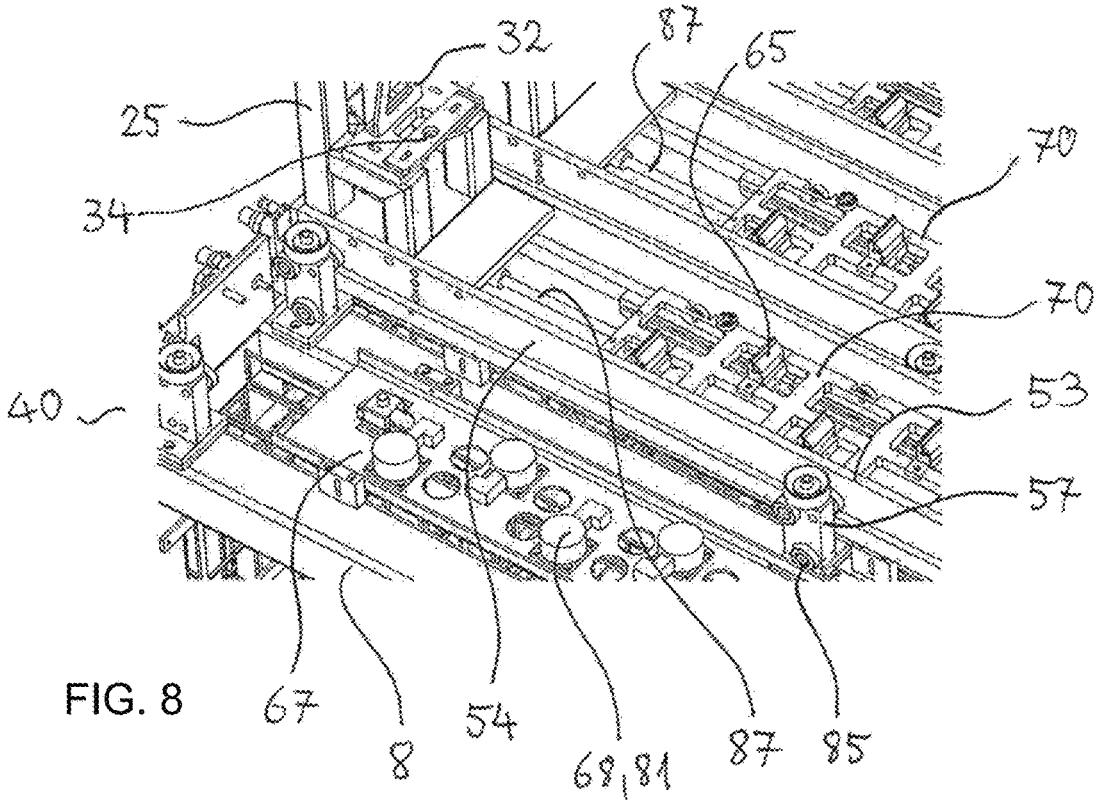
FIG. 8 is another enlarged perspective view of the storage region of the single-pass inkjet printer in accordance with FIG. 7, the storage apparatus with a doctor blade carrier having been pushed out.

In FIG. 8, details of the storage region 40 and, in particular, of the displaceable storage apparatuses 54 can be seen in a plan view. The protective cover 53 of a storage apparatus 54 which is pushed in can be seen clearly. The front storage apparatus 54 (at the bottom in FIG. 8) is pushed out.

Each storage apparatus 54 has a doctor blade carrier 70 which can be displaced in the X-direction and carries a plurality of doctor blades 65 which are mounted thereon in accordance with FIG. 7. In each case one doctor blade drive device 87 is assigned for displacing the doctor blade carrier 70 in a to and fro movement along the X-direction. To this end, for example, an electric motor is provided which acts directly on the doctor blade carrier 70 via a spindle drive. Furthermore, the left-hand open bearing 34 can be seen clearly in FIG. 8 on the storage apparatus 54 which is pushed in, which open bearing 34 has a conical seat for receiving a bearing piece 30 of a set print head module 6, which bearing piece 30 is configured as a ball pivot. Furthermore, a part of the load-bearing construction 25 and the catching device 32 (in the present case, the catching wedge) can be seen.

If the storage apparatus 54 is displaced in the X-direction along the guide elements 57 (a corresponding guide roller 85 is shown in FIGS. 7 and 8), the corresponding setting elements 68 or magnetic elements 81 of the cleaning device 64 remain in the storage region 40. A set print head module 6 remains securely and stably positioned on the storage apparatus 54, the print heads 14 continuing to remain in a securely protected manner in the protective cover 53. The doctor blade setting device 67 is decoupled. If the storage apparatus 54 is moved in, it acts through the bottom of the protective cover 53.

Figure 9:
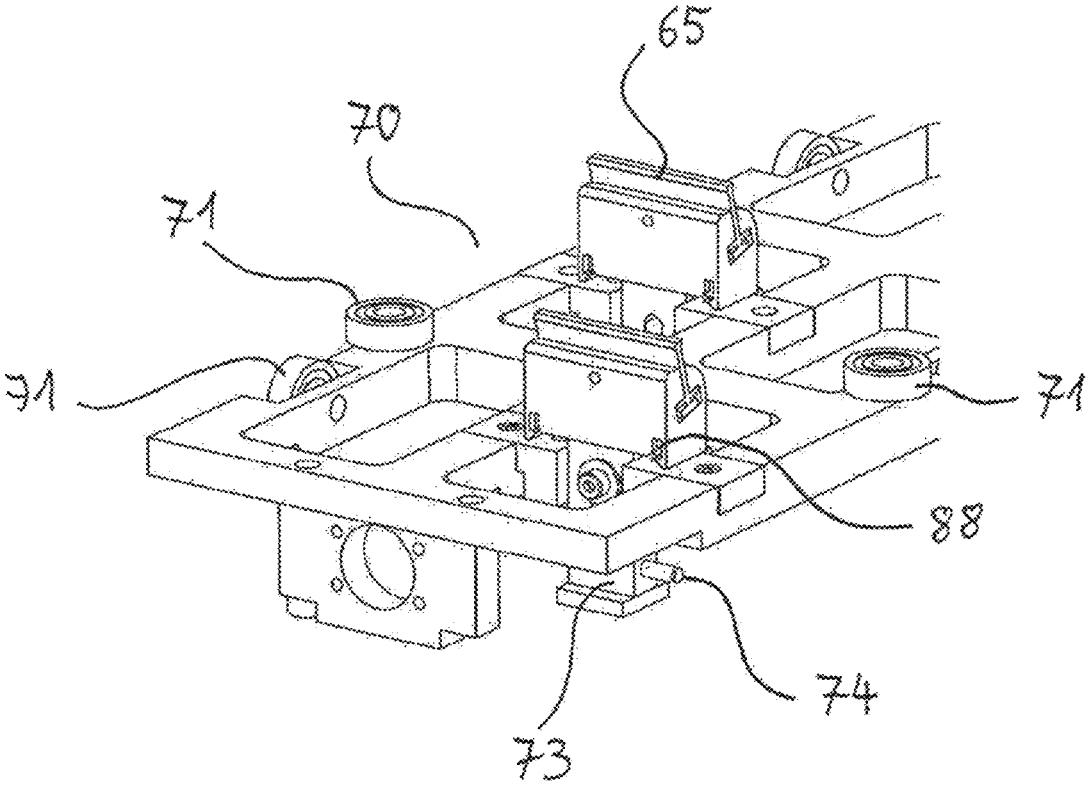
FIG. 9 is a perspective partial view of a displaceable doctor blade carrier of a cleaning device in accordance with FIGS. 7 and 8.

FIG. 9 shows a detailed view of the doctor blade carrier 70. The carrying element 73 and the engagement element 74 which is mounted on it can then be seen clearly, which engagement element 74 is positively guided in the guide tracks 77, 78 in accordance with FIG. 7. The carrying element 73 is prestressed upward with respect to the doctor blade carrier 70 via a spring element 88. Guide rollers 71, the rotational axes of which extend in the Z-direction and in the Y-direction, can likewise be seen clearly.

The invention claimed is:

1. A single-pass inkjet printer, comprising:

a running track for guiding a printing medium in a Y-direction;

a plurality of print head modules disposed behind one another in the Y-direction and extending in each case with a plurality of print heads in an X-direction transversely over said running track;

a printing region in which said print head modules are mounted such that they stand upright in a respective printing position substantially in a Z-direction and can be inserted and removed reversibly along the Z-direction;

a protective cover;

a storage region being offset in the X-direction or in the Y-direction with respect to said printing region and in said storage region a number of said print head modules being mounted such that said print head modules stand upright in a respective storage position substantially in the Z-direction and are inserted and removed reversibly along the Z-direction, the Z-direction being orthogonal with respect to both the X-direction and the Y-direction, said print heads of said print head modules which are set in the respective storage position being received in said protective cover;

a cleaning device disposed in said storage region, said cleaning device having a number of doctor blade carriers which are assigned to in each case one storage position, can be displaced in the X-direction, and in each case carry a number of doctor blades;

each of said doctor blades is guided on a respective one of said doctor blade carriers such that said doctor blade is adjusted in the Z-direction between a cleaning position and a distance position;

doctor blade setting devices, each of said doctor blade setting devices for adjusting in each case one of said doctor blades between the cleaning position and the distance position;

first guide tracks extending in the X-direction;

second guide tracks extending in the X-direction; and connecting sections each connecting one of said first guide tracks to one of said second guide tracks, wherein each of said doctor blades is positively guided in the cleaning position along said one first guide track and is positively guided in the distance position along said one second guide track, and said doctor blade setting devices being configured for switchable determining which of said first and second guide tracks is to be taken.

2. The single-pass inkjet printer according to claim 1, wherein precisely one of said doctor blades is assigned to each of said doctor blade carriers for each of said print heads of a set of said print head modules.

3. The single-pass inkjet printer according to claim 1, wherein said cleaning device has a drive device for displacing a or each of said doctor blade carriers.

4. The single-pass inkjet printer according to claim 1 wherein at each said respective storage position, said cleaning device has a drive device for displacing in each case one of said doctor blade carriers.

5. The single-pass inkjet printer according to claim 1, further comprising engagement elements disposed in said first guide tracks or in said second guide tracks, each of said doctor blades is guided by means of said one of said engagement elements; and wherein said doctor blade setting devices each have a magnetic element which acts on a respective one of said engagement elements in a respective one of said connecting sections.

6. The single-pass inkjet printer according to claim 1, wherein said cleaning device has a drive device for displacing a or each of said doctor blade carriers along the X-direction.

7. A single-pass inkjet printer, comprising:

a running track for guiding a printing medium in a Y-direction;

a plurality of print head modules disposed behind one another in the Y-direction and extending in each case with a plurality of print heads in an X-direction transversely over said running track;

a printing region in which said print head modules are mounted such that they stand upright in a respective printing position substantially in a Z-direction and can be inserted and removed reversibly along the Z-direction;

a protective cover;

a storage region being offset in the X-direction or in the Y-direction with respect to said printing region and in said storage region a number of said print head modules being mounted such that said print head modules stand upright in a respective storage position substantially in the Z-direction and are inserted and removed reversibly along the Z-direction, the Z-direction being orthogonal with respect to both the X-direction and the Y-direction, said print heads of said print head modules which are set in the respective storage position being received in said protective cover;

a maintenance region being offset in the X-direction with respect to said storage region, in said maintenance region said print head modules are mounted such that said print head modules stand upright in a respective maintenance position substantially in the Z-direction and can be inserted and removed reversibly along the Z-direction; and said storage region provides, for each of said print head modules, in each case one storage apparatus which can be displaced in the X-direction and in which a set print head module assumes a storage position, said protective cover being a part of said storage apparatus, and in that said storage region and said maintenance region can be coupled in such a way that said storage apparatus can be displaced with said set print head module in the Z-direction out of said storage region onto said maintenance region.

8. The single-pass inkjet printer according to claim 7, wherein said storage region and said maintenance region in each case have guide elements for guiding said storage apparatus, it being possible for said guide elements of said storage region and said guide elements of said maintenance region to be coupled to one another in order to form a displacement track which is continuous in the X-direction.

9. The single-pass inkjet printer according to claim 7, wherein said maintenance region is configured as a mobile maintenance carriage.

10. The single-pass inkjet printer according to claim 7, wherein said maintenance region has a stop buffer and a fixing element for each said storage apparatus which is moved in.

11. The single-pass inkjet printer according to claim 7, further comprising a cleaning device disposed in said storage region, said cleaning device having a number of doctor blade carriers which are assigned to in each case one storage position, can be displaced in the X-direction, and in each case carry a number of doctor blades.

12. The single-pass inkjet printer according to claim 11, wherein precisely one of said doctor blades is assigned to each of said doctor blade carriers for each of said print heads of a set of said print head modules.

13. The single-pass inkjet printer according to claim 11, wherein said cleaning device has a drive device for displacing a or each of said doctor blade carriers.

14. The single-pass inkjet printer according to claim 11, wherein at each said respective storage position, said cleaning device has a drive device for displacing in each case one of said doctor blade carriers.

15. The single-pass inkjet printer according to claim 11, wherein each of said doctor blades is guided on a respective one of said doctor blade carriers such that said doctor blade is adjusted in the Z-direction between a cleaning position and a distance position; and further comprising doctor blade setting devices, each of said doctor blade setting devices for adjusting in each case one of said doctor blades between the cleaning position and the distance position.

16. The single-pass inkjet printer according to claim 15, further comprising:

first guide tracks extending in the X-direction;

second guide tracks extending in the X-direction; and connecting sections each connecting one of said first guide tracks to one of said second guide tracks, wherein each of said doctor blades is positively guided in the cleaning position along said one first guide track and is positively guided in the distance position along said one second guide track, and said doctor blade setting devices being configured for switchable determining which of said first and second guide tracks is to be taken.

17. The single-pass inkjet printer according to claim 16, further comprising engagement elements disposed in said first guide tracks or in said second guide tracks, each of said doctor blades is guided by means of said one of said engagement elements; and wherein said doctor blade setting devices each have a magnetic element which acts on a respective one of said engagement elements in a respective one of said connecting sections.

* * * * *